US011041230B2

(12) United States Patent
Xu et al.

(10) Patent No.: US 11,041,230 B2
(45) Date of Patent: Jun. 22, 2021

(54) MAGNESIUM ALLOY AND PREPARATION METHOD THEREOF

(71) Applicant: CITIC Dicastal CO., LTD., Qinhuangdao (CN)

(72) Inventors: Zuo Xu, Qinhuangdao (CN); Guoyuan Xiong, Qinhuangdao (CN); Chunhai Liu, Qinhuangdao (CN); Lixin Huang, Qinhuangdao (CN); Yongfei Li, Qinhuangdao (CN); Long Zhai, Qinhuangdao (CN); Kedi Ding, Qinhuangdao (CN); Liguo Yang, Qinhuangdao (CN)

(73) Assignee: CITIC DICASTAL CO., LTD, Qinhuangdao (CN)

( * ) Notice: Subject to any disclaimer, the term of this patent is extended or adjusted under 35 U.S.C. 154(b) by 58 days.

(21) Appl. No.: 16/550,772

(22) Filed: Aug. 26, 2019

(65) Prior Publication Data

US 2020/0399741 A1 Dec. 24, 2020

(30) Foreign Application Priority Data

Jun. 21, 2019 (CN) ..... 201910545166.4

(51) Int. Cl.

| | |
|---|---|
| ***C22F 1/06*** | (2006.01) |
| ***C22C 23/02*** | (2006.01) |
| ***B22D 7/00*** | (2006.01) |
| ***C22C 1/02*** | (2006.01) |

(52) U.S. Cl.

CPC ..... *C22C 23/02* (2013.01); *B22D 7/005* (2013.01); *C22C 1/02* (2013.01); *C22F 1/06* (2013.01)

(58) Field of Classification Search

CPC ..... C22C 23/02; C22C 1/02; C22F 1/06

See application file for complete search history.

(56) References Cited

FOREIGN PATENT DOCUMENTS

| | | | |
|---|---|---|---|
| CN | 1241641 | A | 1/2000 |
| CN | 1814837 | A | 8/2006 |
| CN | 101787473 | A | 7/2010 |
| CN | 105525179 | A | 4/2016 |
| CN | 106834846 | A | 6/2017 |
| CN | 109182860 | A | 1/2019 |

*Primary Examiner* — Jessee R Roe

(74) *Attorney, Agent, or Firm* — Cooper Legal Group, LLC

(57) ABSTRACT

The present disclosure provides a magnesium alloy and a preparation method thereof. The magnesium alloy comprises: Al: 7.01-9.98 wt %; Zn: 0.1-1.2 wt %; Mn: 0.05-0.2 wt %; Sn: 0.3-2.5 wt %; Sm: 0.1-0.5 wt %; and a balance of Mg.

7 Claims, 21 Drawing Sheets

| (at.%) | Mg | Al | Zn | Mn | Sm | Sn | Phase |
|---|---|---|---|---|---|---|---|
| A | 93.5 | 6.5 | -- | -- | -- | -- | $Mg_{17}Al_{12}$ |
| B | 53.1 | 38.7 | | 0.1 | 8.05 | -- | Mg-Al-Mn-Sm |
| C | 76.2 | 16.6 | -- | -- | -- | 7.2 | Mg-Al-Sn |
| D | 62.03 | 19.4 | 0.3 | -- | -- | 18.27 | Mg-Al-Sn |
| E | 74.6 | 14.6 | 0.63 | -- | 10.17 | -- | Mg-Al-Sm |

FIG. 10

| (at.%) | Mg | Al | Zn | Mn | Phase |
|---|---|---|---|---|---|
| A | 93.5 | 6.5 | -- | -- | $Mg_{17}Al_{12}$ |
| B | 91.6 | 8.4 | -- | -- | $Mg_{17}Al_{12}$ |
| C | 92.8 | 7.2 | -- | -- | $Mg_{17}Al_{12}$ |

FIG. 11

MAGNESIUM ALLOY AND PREPARATION METHOD THEREOF

CROSS-REFERENCE TO RELATED APPLICATIONS

This application claims priority to Chinese Patent Application No. 201910545166.4, filed on Jun. 21, 2019, the contents of which are hereby incorporated by reference in its entirety.

BACKGROUND

The magnesium alloy is an ideal material for structure lightweight, has the advantages of low density, high specific strength, easiness in reutilization, good vibration-damping behavior, electromagnetic shielding performance and machining property, etc. and has a broad application prospect in the fields of automobiles, aerospace, 3C, national defense, etc. Mg—Al alloys mainly have commercial alloy grades, for example AZ31, AM60, AZ61, AZ80 and AZ91 which have already become commercial magnesium alloys with the most extensive application.

However, both the alloy strength and plasticity of the magnesium alloy are relatively low at room temperature and are difficultly compromised, and thus, the extensive use of the magnesium alloy is restricted; and the magnesium alloy further has the characteristics of low ignition point and inflammability which cause inconvenience to industrial production, and thus, the extensive use of the magnesium alloy is further hindered.

SUMMARY

The present disclosure relates to metal surface treatment and particularly relates to a magnesium alloy and a preparation method thereof.

The present disclosure provides a magnesium alloy and a preparation method thereof. The magnesium alloy and the preparation method thereof enable magnesium alloys to have better strength and plasticity.

In one aspect, the present disclosure provides a magnesium alloy. The magnesium alloy comprises:

Al (aluminum): 7.01-9.98 wt %; Zn (zinc): 0.1-1.2 wt %; Mn (manganese): 0.05-0.2 wt %; Sn (stannum): 0.3-2.5 wt %; Sm (samarium): 0.1-0.5 wt %; and the balance of Mg (magnesium).

In one embodiment, the magnesium alloy further comprises the following ingredient:

Y (yttrium): 0.05-0.1 wt %.

In one embodiment, the magnesium alloy further comprises the following ingredient:

Ca (calcium): 0.05-0.2 wt %.

In another aspect, the present disclosure further provides a preparation method of the magnesium alloy. The method is applied to any of magnesium alloy described above and comprises the steps:

heating a solid raw material of Mg to 700-730° C. for melting to form a Mg melt;

heating solid raw materials of the rest ingredients to preset temperatures of the ingredients, then, adding the Mg melt for melting, and stirring for a preset time to form a mixed melt; and solidifying the mixed melt to form the magnesium alloy.

In one embodiment, the step of heating solid raw materials of the rest ingredients to preset temperatures of the ingredients, then, adding the Mg melt for melting, and stirring for a preset time to form the mixed melt comprises:

separately heating solid raw materials of Sn and Zn to 50-100° C., heating solid raw materials of Al, Mn, Sm, Y and Ca to 150-250° C., adding the Mg melt, raising the temperature of the Mg melt by 20-40° C., maintaining the raised temperature for 5-15 minutes, and then, stirring for 3-10 minutes to form the mixed melt.

In one embodiment, after the step of heating solid raw materials of the rest ingredients to preset temperatures of the ingredients, then, adding the Mg melt for melting, and stirring for a preset time to form the mixed melt and before the step of solidifying the mixed melt to form the magnesium alloy, the method further comprises:

lowering the temperature of the mixed melt by 20-40° C. for refining degassing treatment, and then, maintaining the lowered temperature for 3-15 minutes for standing treatment.

In one embodiment, forming the mixed melt through heating all the ingredients in sequence for melting all the ingredients is performed under the protection of $CO_2$ (carbon dioxide)/$SF_6$ (sulfur hexafluoride) mixed gas.

In one embodiment, the step of solidifying the mixed melt to form the magnesium alloy comprises:

removing dross on the surface of the mixed melt, and then, preparing magnesium alloy ingots by gravity casting or semicontinuous casting.

In one embodiment, after the step of removing dross on the surface of the mixed melt, and then, preparing magnesium alloy ingots by gravity casting or semicontinuous casting, the method further comprises:

performing solid solution treatment on the magnesium alloy ingots, in which the solid solution treatment comprises:

performing solid solution treatment for 7-24 hours at a temperature of 380-430° C., and then, quenching with warm water with a temperature of 40-80° C.

In one embodiment, after the step of performing solid solution treatment on the magnesium alloy ingots, the method further comprises:

performing aging treatment on the magnesium alloy ingots, in which the aging treatment comprises:

firstly maintaining a temperature of 300-350° C. for 0.5-2 h, then maintaining a temperature of 150-200° C. for 8-15 h, and finally cooling to room temperature.

According to the magnesium alloy and the preparation method thereof provided by the embodiments of the present disclosure, the magnesium alloy comprises the following ingredients:

Al: 7.01-9.98 wt %; Zn: 0.1-1.2 wt %; Mn: 0.05-0.2 wt %; Sn: 0.3-2.5 wt %; Sm: 0.1-0.5 wt %; and the balance of Mg. Obviously, according to the magnesium alloy and the preparation method thereof provided by the embodiments of the present disclosure, through adding novel chemical elements and adopting a proper ingredient ratio, the magnesium alloy can have better strength and plasticity.

Other beneficial effects of the embodiments of the present disclosure will be further described in specific embodiments in conjunction with specific technical solutions.

BRIEF DESCRIPTION OF THE DRAWINGS

FIG. 4*a*, as-cast state; FIG. 4*b*, T6 state; and FIG. 4*c*, as-extruded state;

FIG. 5*a*, as-cast state; FIG. 5*b*, T6 state; and FIG. 5*c*, as-extruded state;

FIG. 6*a*, T6 state; and FIG. 6*b*, as-extruded state;

FIG. 7*a*, T6 state; and FIG. 7*b*, as-extruded state;

FIG. 8*a*, as-cast state; FIG. 8*b*, T6 state; and FIG. 8*c*, as-extruded state;

FIG. 9*a*, as-cast state; FIG. 9*b*, T6 state; and FIG. 9*c*, as-extruded state;

FIG. 10 shows an EDS (Energy Dispersive Spectrometer) elemental analysis result of Example 1; and FIG. 11 shows an EDS elemental analysis result of the Comparative Example.

DETAILED DESCRIPTION

Figure 1:
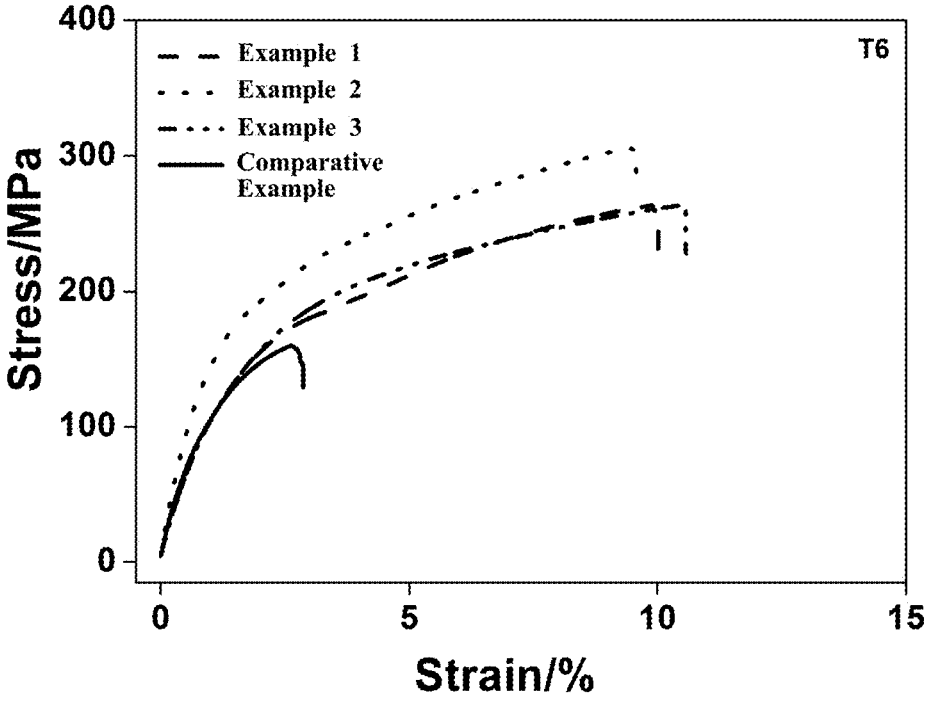
FIG. 1 shows stress-strain curves of Examples 1-3 and the Comparative Example of the present disclosure in as-cast state at room temperature.

In the related art, some solutions to the problem of strength of magnesium alloys are present, however, effects are not entirely as desired yet, for example an invention patent with the publication number of CN1241641A and named 'a cast flame-retardant magnesium alloy and smelting and casting processes thereof' provides a flame-retardant magnesium alloy containing Al, Sr and Be and rare-earth elements, and the ignition point of the flame-retardant magnesium alloy can reach 740° C. However, the tensile strength of the flame-retardant magnesium alloy is only 160 MPa, the elongation percentage is only 2%, and the strength and the elongation percentage cannot meet requirements of present industrial applications. Furthermore, Be and compounds thereof are highly toxic substances, during alloy smelting, great harm is caused to physical health of operating personnel, serious pollution is caused to air and soil around a factory district, and thus, Be and compounds thereof are adverse to environmental protection.

Again, an invention patent with the publication number of CN101787473A and named 'a tough flame-retardant magnesium alloy and a preparation method thereof' discloses the tough flame-retardant magnesium alloy and the preparation method thereof, and the tough flame-retardant magnesium alloy has the components in percentage by weight: 5.0-12.0% of Gd, 0.5-3.0% of Er, 0-1.0% of Mn, 0-0.8% of Zr and the balance of Mg.

Although the alloy has a good flame-retardant effect, the amount of use of rare earths in the present patent is relatively large, and thus, the product cost is increased greatly, which is adverse to industrial production.

Then again, an invention patent with the publication number of CN105525179A and named 'a preparation method of rare-earth magnesium alloy large-size high-strength forgings' discloses a high-strength magnesium alloy, the high-strength magnesium alloy comprises the ingredients: $7.5 \leq Gd \leq 9.5$, $3.5 \leq Y \leq 5.0$, $1.0 \leq Zn \leq 1.5$, $0.3 \leq Mn \leq 0.6$ and the balance of magnesium; and after deformation and heat treatment, the room-temperature strength of the forgings reach 430 MPa. However, a large amount of rare-earth elements are adopted, the specific weight is large, the lightweight advantage of the magnesium alloy cannot be brought into full play, and the requirements on large-scale industrial production cannot be met.

In view of the above-mentioned problems, embodiments of the present disclosure provide a magnesium alloy, which comprises the following ingredients:

Al: 7.01-9.98 wt %; Zn: 0.1-1.2 wt %; Mn: 0.05-0.2 wt %; Sn: 0.3-2.5 wt %; Sm: 0.1-0.5 wt %; and the balance of Mg.

According to the magnesium alloy provided by the embodiments of the present disclosure, through adding novel chemical elements and adopting a proper ingredient ratio, the magnesium alloy can have better strength and plasticity.

In one embodiment, the magnesium alloy further comprises the following ingredient:

Y: 0.05-0.1 wt %.

In this way, the magnesium alloy is higher in melting point and better in flame-retardant effect.

In one embodiment, the magnesium alloy further comprises the following ingredient:

Ca: 0.05-0.2 wt %.

In this way, the ignition point of the magnesium alloy can be increased, and the corrosion resistance of the magnesium alloy can also be improved.

Embodiments of the present disclosure further provide a preparation method of the magnesium alloy. The method is applied to any of magnesium alloy described above and comprises the steps:

heating a solid raw material of Mg to 700-730° C. for melting to form a Mg melt;

heating solid raw materials of the rest ingredients to preset temperatures of the ingredients, then adding the Mg melt for melting, and stirring for a preset time to form a mixed melt; and solidifying the mixed melt to form the magnesium alloy.

In one embodiment, the step of heating solid raw materials of the rest ingredients to preset temperatures of the ingredients, then, adding the Mg melt for melting, and stirring for a preset time to form the mixed melt comprises:

separately heating solid raw materials of Sn and Zn to 50-100° C., heating solid raw materials of Al, Mn, Sm, Y and Ca to 150-250 adding the Mg melt, raising the temperature of the Mg melt by 20-40° C., maintaining the raised temperature for 5-15 minutes, and then, stirring for 3-10 minutes to form the mixed melt. In this way, different materials can be better mixed with the Mg melt by setting different heating temperatures. In addition, moisture attached to the solid raw materials can be evaporated by heating the solid raw materials, and thus, water is prevented from being mixed into the melt.

Herein, a solid raw material of Sn may be pure Sn blocks, a solid raw material of Zn may be pure Zn blocks, a solid raw material of Al may be pure Al blocks, and pure solid blocks are relatively easily obtained from these materials.

A solid raw material of Mn may be Mg—Mn inter-alloy blocks, a solid raw material of Sm may be Mg—Sm inter-alloy blocks, a solid raw material of Y may be Mg—Y inter-alloy blocks, a solid raw material of Ca may be Mg—Ca inter-alloy blocks, and pure solid blocks are difficultly obtained from these materials, so that the inter-alloy blocks are employed.

In one embodiment, after the step of heating solid raw materials of the rest ingredients to preset temperatures of the ingredients, then, adding the Mg melt for melting, and stirring for a preset time to form the mixed melt and before the step of solidifying the mixed melt to form the magnesium alloy, the method further comprises:

lowering the temperature of the mixed melt by 20-40° C. for refining degassing treatment, and then, maintaining the lowered temperature for 3-15 minutes for standing treatment. In this way, gas can be removed, the purity of the melt can be improved.

In one embodiment, forming the mixed melt through heating all the ingredients in sequence for melting all the ingredients is performed under the protection of $CO_2/SF_6$ mixed gas. In this way, an oxidation reaction does not easily occur.

In one embodiment, the step of solidifying the mixed melt to form the magnesium alloy comprises:

removing dross on the surface of the mixed melt, and then, preparing magnesium alloy ingots by gravity casting or semicontinuous casting. In this way, the dross can be effectively removed.

In one embodiment, after the step of removing dross on the surface of the mixed melt, and then, preparing the magnesium alloy ingots by gravity casting or semicontinuous casting, the method further comprises:

performing solid solution treatment on the magnesium alloy ingots, in which the solid solution treatment comprises:

performing solid solution treatment for 7-24 hours at a temperature of 380-430 and then, quenching with warm water with a temperature of 40-80° C. In this way, the magnesium alloy can have better plasticity and toughness, in which warm-water quenching has the advantage that quenching deformation or stress-caused defects such as cracks resulting from quenching can be avoided.

In one embodiment, after the step of performing solid solution treatment on the magnesium alloy ingots, the method further comprises:

performing aging treatment on the magnesium alloy ingots, in which the aging treatment comprises:

firstly maintaining a temperature of 300-350° C. for 0.5-2 h, then maintaining a temperature of 150-200° C. for 8-15 h, and finally cooling to room temperature, namely double-stage aging treatment. Properties of the magnesium alloy can be more stable due to the aging treatment. The double-stage aging treatment has the advantages that the size of a second phase of the alloy is controlled and can be smaller, and meanwhile, the efficiency of heat treatment is increased.

In one embodiment, the magnesium alloy ingots subjected to the solid solution treatment or aging treatment can be subjected to extruding treatment to obtain part blanks with higher strength. Of course, part blanks with high strength can also be obtained through direct extrusion without solid solution and aging, however, the performance stability is not good enough.

Detailed technical solutions related to the present disclosure will be described below in conjunction with drawings and specific Examples, and it should be understood that the attached drawings and the Examples are only intended to explain the present disclosure rather than define the present disclosure.

Example 1

The present Example provides a magnesium alloy, and the magnesium alloy provided by the present Example comprises the following ingredients:

Al: 7.3 wt %; Zn: 0.3 wt %; Mn: 0.1 wt %; Sn: 0.5 wt %; Sm: 0.5 wt %; Y: 0.05 wt %; Ca: 0.05 wt %; and the balance of Mg.

Example 2

The present Example provides a magnesium alloy, and the magnesium alloy provided by the present Example comprises the following ingredients:

Al: 7.3 wt %; Zn: 0.3 wt %; Mn: 0.1 wt %; Sn: 0.7 wt %; Sm: 0.3 wt %; Y: 0.04 wt %; Ca: 0.1 wt %; and the balance of Mg.

Example 3

The present Example provides a magnesium alloy, and the magnesium alloy provided by the present Example comprises the following ingredients:

Al: 7.3 wt %; Zn: 0.3 wt %; Mn: 0.1 wt %; Sn: 1.2 wt %; Sm: 0.2 wt %; Y: 0.08 wt %; Ca: 0.06 wt %; and the balance of Mg.

Example 4

The present Example provides a magnesium alloy, and the magnesium alloy provided by the present Example comprises the following ingredients:

Al: 9.8 wt %; Zn: 0.4 wt %; Mn: 0.1 wt %; Sn: 0.6 wt %; Sm: 0.5 wt %; Y: 0.04 wt %; Ca: 0.05 wt %; and the balance of Mg.

Example 5

The present Example provides a magnesium alloy, and the magnesium alloy provided by the present Example comprises the following ingredients:

Al: 9.98 wt %; Zn: 0.6 wt %; Mn: 0.1 wt %; Sn: 0.8 wt %; Sm: 0.5 wt %; Y: 0.04 wt %; Ca: 0.08 wt %; and the balance of Mg.

Example 6

The present Example provides a magnesium alloy, and the magnesium alloy provided by the present Example comprises the following ingredients:

Al: 8.6 wt %; Zn: 0.4 wt %; Mn: 0.15 wt %; Sn: 1.5 wt %; Sm: 0.3 wt %; Y: 0.1 wt %; Ca: 0.2 wt %; and the balance of Mg.

Example 7

The present Example provides a magnesium alloy, and the magnesium alloy provided by the present Example comprises the following ingredients:

Al: 8.6 wt %; Zn: 0.8 wt %; Mn: 0.2 wt %; Sn: 2.5 wt %; Sm: 0.5 wt %; Y: 0.06 wt %; Ca: 0.1 wt %; and the balance of Mg.

Example 8

The present Example provides a magnesium alloy, and the magnesium alloy provided by the present Example comprises the following ingredients:

Al: 7.3 wt %; Zn: 0.1 wt %; Mn: 0.1 wt %; Sn: 0.3 wt %; Sm: 0.4 wt %; Y: 0.09 wt %; Ca: 0.12 wt %; and the balance of Mg.

Example 9

The present Example provides a magnesium alloy, and the magnesium alloy provided by the present Example comprises the following ingredients:

Al: 7.01 wt %; Zn: 0.5 wt %; Mn: 0.05 wt %; Sn: 2 wt %; Sm: 0.1 wt %; Y: 0.06 wt %; Ca: 0.15 wt %; and the balance of Mg.

Example 10

The present Example provides a magnesium alloy, and the magnesium alloy provided by the present Example comprises the following ingredients:

Al: 7.8 wt %; Zn: 0.4 wt %; Mn: 0.12 wt %; Sn: 0.6 wt %; Sm: 0.4 wt %; Y: 0.05 wt %; Ca: 0.07 wt %; and the balance of Mg.

Example 11

The present Example provides a magnesium alloy, and the magnesium alloy provided by the present Example comprises the following ingredients:

Al: 9.98 wt %; Zn: 1 wt %; Mn: 0.2 wt %; Sn: 2 wt %; Sm: 0.5 wt %; and the balance of Mg.

Example 12

The present Example provides a magnesium alloy, and the magnesium alloy provided by the present Example comprises the following ingredients:

Al: 7.8 wt %; Zn: 1.2 wt %; Mn: 0.12 wt %; Sn: 1.7 wt %; Sm: 0.4 wt %; and the balance of Mg.

Example 13

The present Example provides a preparation method of the magnesium alloy. A component of the preparation method may be any one of Examples 1-12, and the preparation method comprises the following steps:

Step 1301: heating a solid raw material of Mg to 720° C. for melting to form a Mg melt;

Step 1302: heating solid raw materials of Sn and Zn to 100° C.; Step 1303: heating solid raw materials of Al, Mn, Sm, Y and Ca to 150;

Step 1304: adding the heated solid raw materials of Sn, Zn, Al, Mn, Sm, Y and Ca into the Mg melt;

Step 1305: raising the temperature of the Mg melt by 30 maintaining the raised temperature for 7 minutes, then, stirring for 3 minutes to form a mixed melt; particularly, specifically, forming the mixed melt is performed under the protection of $CO_2/SF_6$ mixed gas;

Step 1306: lowering the temperature of the mixed melt by 30° C. for refining degassing treatment, and then, maintaining the lowered temperature for 10 minutes for standing treatment;

Step 1307: removing dross on the surface of the mixed melt, and then, preparing magnesium alloy ingots by gravity casting;

Step 1308: performing solid solution treatment on the magnesium alloy ingots, in which the solid solution treatment comprises:

performing solid solution treatment for 15 hours at a temperature of 400 and then, quenching with warm water with a temperature of 50° C.; both a heating process and a heat preservation process of the solid solution treatment are performed in an atmospheric atmosphere;

Step 1309: performing aging treatment on the magnesium alloy ingots subjected to solid solution, in which the aging treatment comprises:

firstly, maintaining a temperature of 300° C. for 0.5 h, then, maintaining a temperature of 160° C. for 10 h, i.e. double-stage aging treatment, and finally, cooling to room temperature; and Step 1310: performing extrusion deformation on the magnesium alloy ingots subjected to solid solution to obtain magnesium-alloy part blanks, specifically, firstly, cutting the magnesium alloy ingots into ingot blocks of corresponding sizes according to part shapes; then, extruding the ingot blocks in a die under the conditions that the extrusion speed is 1.2 m/min, the extrusion ratio is 25, and the extrusion temperature is 300 in which the ingot blocks should be heated to the required extrusion temperature in 30 minutes; and after extrusion is completed, performing air cooling on extruded samples.

Example 14

The present Example provides a preparation method of the magnesium alloy. A component of the preparation method may be any one of Examples 1-12, and the preparation method comprises the following steps:

Step 1401: heating a solid raw material of Mg to 730° C. for melting to form a Mg melt;

Step 1402: heating solid raw materials of Sn and Zn to 100° C.;

Step 1403: heating solid raw materials of Al, Mn, Sm, Y and Ca to 250° C.;

Step 1404: adding the heated solid raw materials of Sn, Zn, Al, Mn, Sm, Y and Ca into the Mg melt;

Step 1405: raising the temperature of the Mg melt by 40° C., maintaining the raised temperature for 5 minutes, then, stirring for 3 minutes to form a mixed melt; specifically, forming the mixed melt is performed under the protection of $CO_2/SF_6$ mixed gas;

Step 1406: lowering the temperature of the mixed melt by 40° C. for refining degassing treatment, and then, maintaining the lowered temperature for 15 minutes for standing treatment;

Step 1407: removing dross on the surface of the mixed melt, and then, preparing magnesium alloy ingots by gravity casting;

Step 1408: performing solid solution treatment on the magnesium alloy ingots, in which the solid solution treatment comprises:

performing solid solution treatment for 7 hours at a temperature of 430° C., and then, quenching with warm water with a temperature of 80° C.; both a heating process and a heat preservation process of the solid solution treatment are performed in an atmospheric atmosphere;

Step 1409: performing aging treatment on the magnesium alloy ingots subjected to solid solution, in which the aging treatment comprises:

firstly, maintaining a temperature of 350° C. for 0.5 h, then, maintaining a temperature of 200° C. for 8 h, i.e. double-stage aging treatment, and finally, cooling to room temperature; and Step 1410: performing extrusion deformation on the magnesium alloy ingots subjected to aging treatment to obtain magnesium-alloy part blanks, specifically, firstly, cutting the magnesium alloy ingots into ingot blocks of corresponding sizes according to part shapes; then, extruding the ingot blocks in a die under the conditions that the extrusion speed is 2 m/min, the extrusion ratio is 50, and the extrusion temperature is 400° C., in which the ingot blocks should be heated to the required extrusion temperature in 30 minutes; and after extrusion is completed, performing air cooling on extruded samples.

Example 15

The present Example provides a preparation method of the magnesium alloy. A component of the preparation method may be any one of Examples 1-12, and the preparation method comprises the following steps:

Step 1501: heating a solid raw material of Mg to 700° C. for melting to form a Mg melt;

Step 1502: heating solid raw materials of Sn and Zn to 50° C.;

Step 1503: heating solid raw materials of Al, Mn, Sm, Y and Ca to 200° C.;

Step 1504: adding the heated solid raw materials of Sn, Zn, Al, Mn, Sm, Y and Ca into the Mg melt;

Step 1505: raising the temperature of the Mg melt by 20 maintaining the raised temperature for 15 minutes, then, stirring for 10 minutes to form a mixed melt; specifically, forming the mixed melt is performed under the protection of $CO_2/SF_6$ mixed gas;

Step 1506: lowering the temperature of the mixed melt by 20° C. for refining degassing treatment, and then, maintaining the lowered temperature for 3 minutes for standing treatment;

Step 1507: removing dross on the surface of the mixed melt, and then, preparing magnesium alloy ingots by gravity casting;

Step 1508: performing solid solution treatment on the magnesium alloy ingots, in which the solid solution treatment comprises:

performing solid solution treatment for 24 hours at a temperature of 380° C., and then, quenching with warm water with a temperature of 40° C.; both a heating process and a heat preservation process of the solid solution treatment are performed in an atmospheric atmosphere;

Step 1509: performing aging treatment on the magnesium alloy ingots subjected to solid solution, in which the aging treatment comprises:

firstly, maintaining a temperature of 300° C. for 2 h, then, maintaining a temperature of 150° C. for 15 h, i.e. double-stage aging treatment, and finally, cooling to room temperature; and Step 1510: performing extrusion deformation on the magnesium alloy ingots subjected to aging treatment to obtain magnesium-alloy part blanks, specifically, firstly, cutting the magnesium alloy ingots into ingot blocks of corresponding sizes according to part shapes; then, extruding the ingot blocks in a die under the conditions that the extrusion speed is 1 m/min, the extrusion ratio is 10, and the extrusion temperature is 250° C., in which the ingot blocks should be heated to the required extrusion temperature in 30 minutes; and after extrusion is completed, performing air cooling on extruded samples.

Example 16

The present Example provides a preparation method of the magnesium alloy. A component of the preparation method may be any one of Examples 1-12, and the preparation method comprises the following steps:

Step 1601: heating a solid raw material of Mg to 710° C., for melting to form a Mg melt;

Step 1602: heating solid raw materials of Sn and Zn to 70° C.;

Step 1603: heating solid raw materials of Al, Mn, Sm, Y and Ca to 220° C.;

Step 1604: adding the heated solid raw materials of Sn, Zn, Al, Mn, Sm, Y and Ca into the Mg melt;

Step 1605: raising the temperature of the Mg melt by 30° C., maintaining the raised temperature for 10 minutes, then, stirring for 5 minutes to form a mixed melt; specifically, forming the mixed melt is performed under the protection of $CO_2/SF_6$ mixed gas;

Step 1606: lowering the temperature of the mixed melt by 30° C. for refining degassing treatment, and then, maintaining the lowered temperature for 5 minutes for standing treatment;

Step 1607: removing dross on the surface of the mixed melt, and then, preparing magnesium alloy ingots by gravity casting;

Step 1608: performing solid solution treatment on the magnesium alloy ingots, in which the solid solution treatment comprises:

performing solid solution treatment for 20 hours at a temperature of 400 and then, quenching with warm water with a temperature of 60° C.; both a heating process and a heat preservation process of the solid solution treatment are performed in an atmospheric atmosphere;

Step 1609: performing aging treatment on the magnesium alloy ingots subjected to solid solution, in which the aging treatment comprises:

firstly, maintaining a temperature of 320° C. for 1.5 h, then, maintaining a temperature of 180° C. for 12 h, i.e. double-stage aging treatment, and finally, cooling to room temperature; and Step 1610: performing extrusion deformation on the magnesium alloy ingots subjected to aging treatment to obtain magnesium-alloy part blanks, specifically, firstly, cutting the magnesium alloy ingots into ingot blocks of corresponding sizes according to part shapes; then, extruding the ingot blocks in a die under the conditions that the extrusion speed is 1.6 m/min, the extrusion ratio is 35, and the extrusion temperature is 350° C., in which the ingot blocks should be heated to the required extrusion temperature in 30 minutes; and after extrusion is completed, performing air cooling on extruded samples.

In order to more clearly understand properties of magnesium alloys provided by the Examples of the present disclosure, commercial magnesium alloy AZ80 serves as a comparative example below and is subjected to mechanical property testing together with the Examples 1-12 above under the same conditions, and test results are shown in a Table 1:

TABLE 1

| | Item | | | |
|---|---|---|---|---|
| Example | Processing state | Tensile strength (MPa) | Yield strength (MPa) | Elongation (%) |
| Example 1 | As-cast state | 218.4 | 111.6 | 6.97 |
| | T6 state | 264 | 139.2 | 9.87 |
| | As-extruded state | 384 | 217.3 | 22.9 |

TABLE 1-continued

| Example | Processing state | Tensile strength (MPa) | Yield strength (MPa) | Elongation (%) |
|---|---|---|---|---|
| | Item | | | |
| Example 2 | As-cast state | 228 | 116.4 | 7.19 |
| | T6 state | 306 | 151.2 | 9.47 |
| | As-extruded state | 394.8 | 214.8 | 24.2 |
| Example 3 | As-cast state | 210 | 109.2 | 6.2 |
| | T6 state | 264 | 140.4 | 10.4 |
| | As-extruded state | 375.6 | 208.8 | 21.9 |
| Comparative Example AZ80 | As-cast state | 165 | 95 | 5.1 |
| | T6 state | 160 | 100 | 2.9 |
| | As-extruded state | 335 | 184 | 16.7 |

Figure 2:
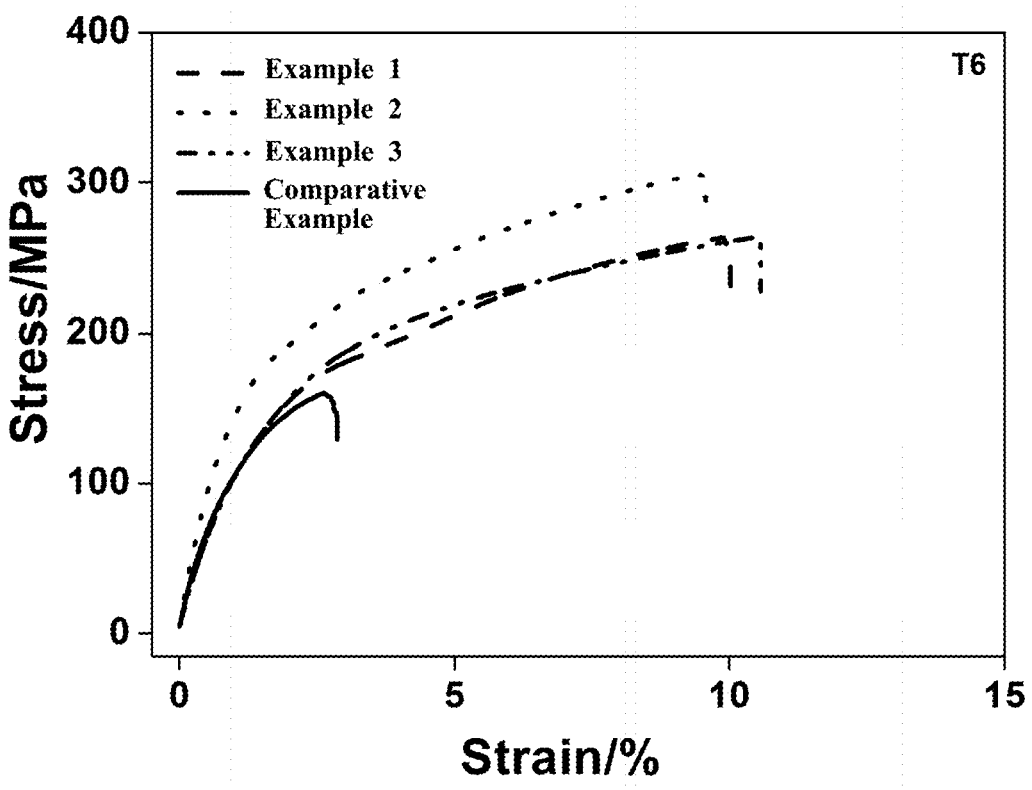
FIG. 2 shows stress-strain curves of Examples 1-3 and the Comparative Example of the present disclosure in T6-state at room temperature.
Figure 3:
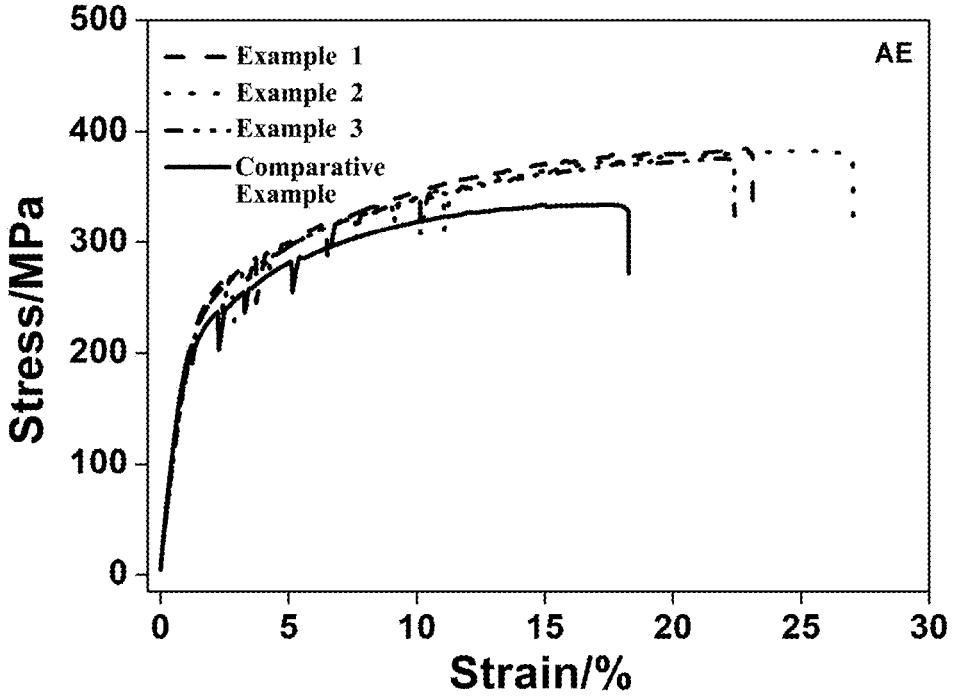
FIG. 3 shows stress-strain curves of Examples 1-3 and the Comparative Example of the present disclosure in as-extruded state at room temperature.

For the sake of brevity, only data of the Examples 1-3 are shown, and data of the other Examples of the present disclosure are similar. In addition, room-temperature stress-strain curves are further made according to test data, and FIG. 1-FIG. 3 show room-temperature stress-strain curves of Examples 1-3 (i.e. Examples 1-3) and a Comparative Example under different states, in which FIG. 1 shows an as-cast state, FIG. 2 shows a T6 state, and FIG. 3 shows an as-extruded state. It is observed that T6-state alloys of the Examples of the present disclosure have the tensile strength of about 260 MPa, the yield strength of about 130 MPa and the elongation percentage of about 10.0%, and extruded-state alloys have the tensile strength of about 380 MPa, the yield strength of about 210 MPa and the elongation percentage of about 23.0%. Mechanical properties are relatively high, and meanwhile, relatively high elongation percentage is also taken into account, so that the magnesium alloys of the Examples of the present disclosure have relatively high strength and toughness. Herein, the as-cast state represents a state just when casting is completed, i.e., a state after the step 1607, the T6 state represents a state after solid solution and artificial aging treatment, i.e., a state after the step 1609, and the as-extruded state represents a state after extrusion deformation, i.e., a state after the step 1610.

Figure 4A:
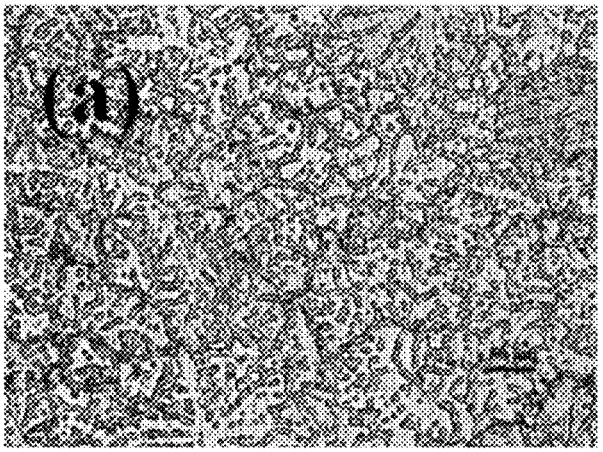
FIG. 4*a*-4*c* shows a microstructure of Example 1 of the present disclosure observed with an OM (Optical Microscope)
Figure 4B:
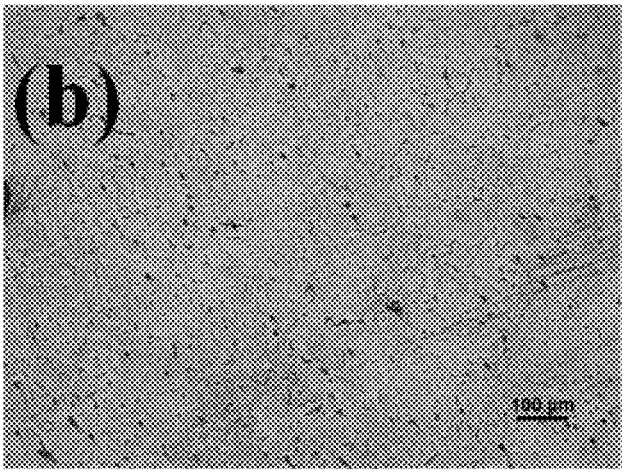
Figure 4C:
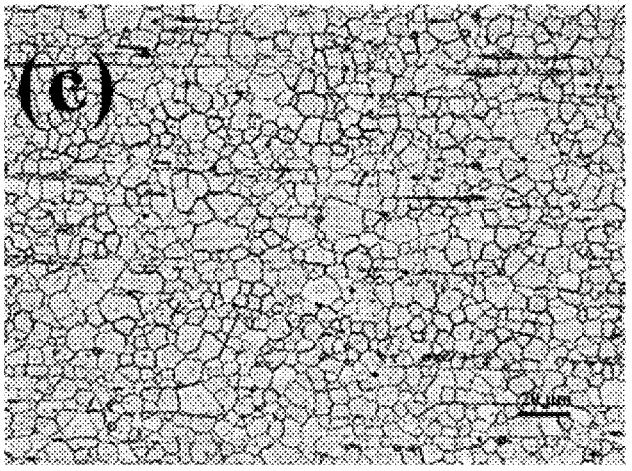
Figure 5A:
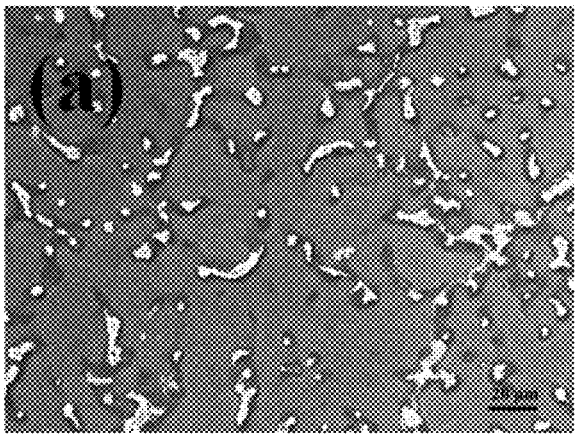
FIG. 5*a*-5*c* shows a microstructure of Example 1 of the present disclosure observed with a SEM (Scanning Electron Microscope)
Figure 5B:
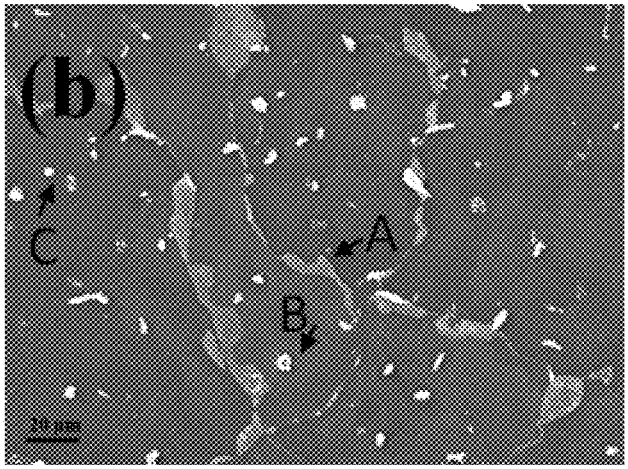
Figure 5C:
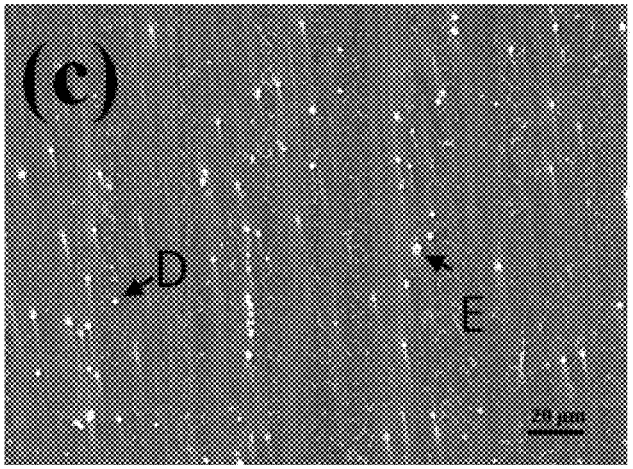
Figure 6A:
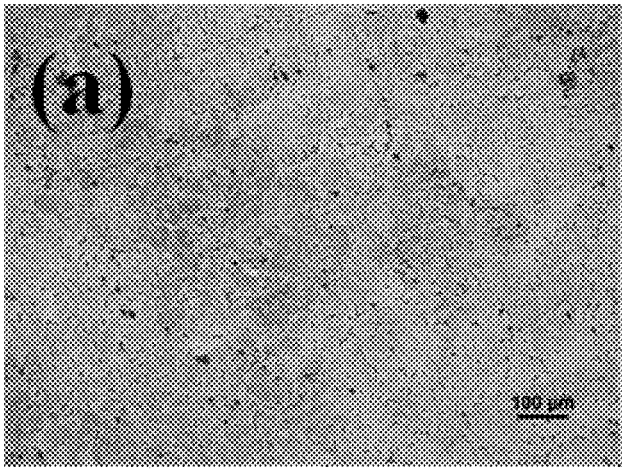
FIG. 6*a*-6*b* shows a microstructure of Example 2 of the present disclosure observed with an OM.
Figure 6B:
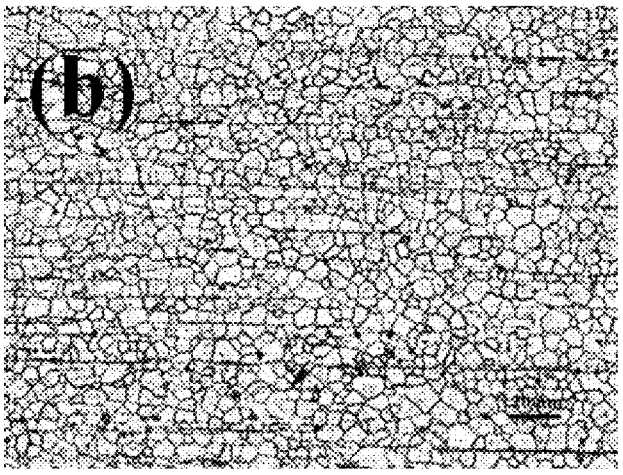
Figure 7A:
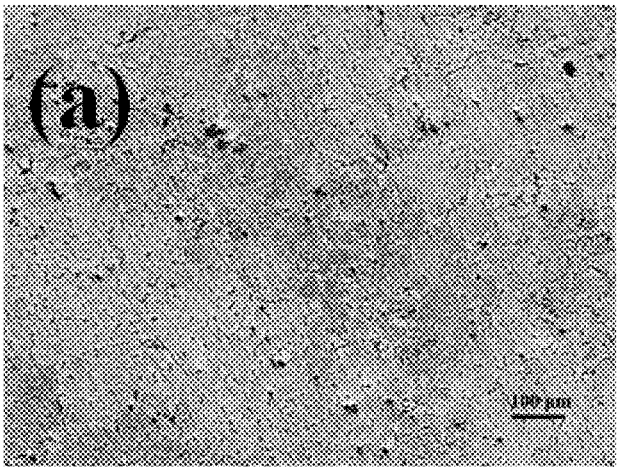
FIG. 7*a*-7*b* shows a microstructure of Example 3 of the present disclosure observed with an OM.
Figure 7B:
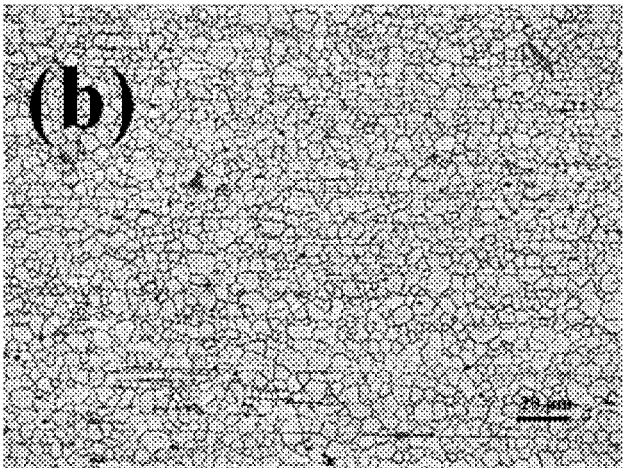
Figure 8A:
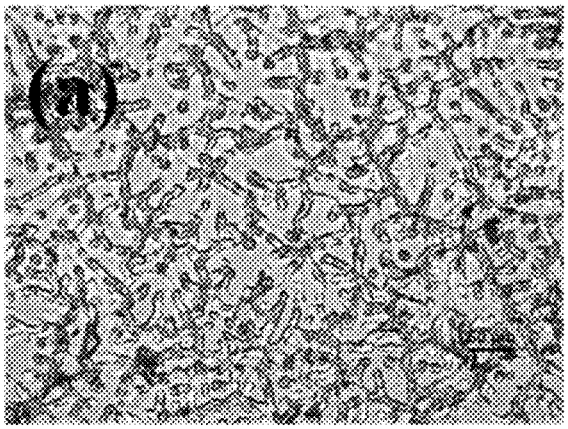
FIG. 8*a*-8*c* shows a microstructure of the Comparative Example of the present disclosure observed with an OM.
Figure 8B:
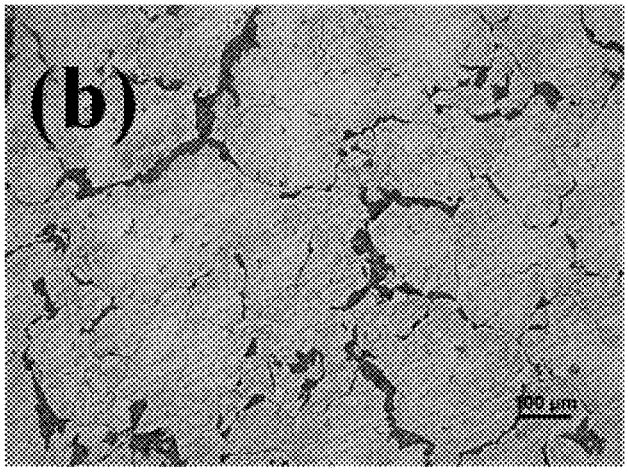
Figure 8C:
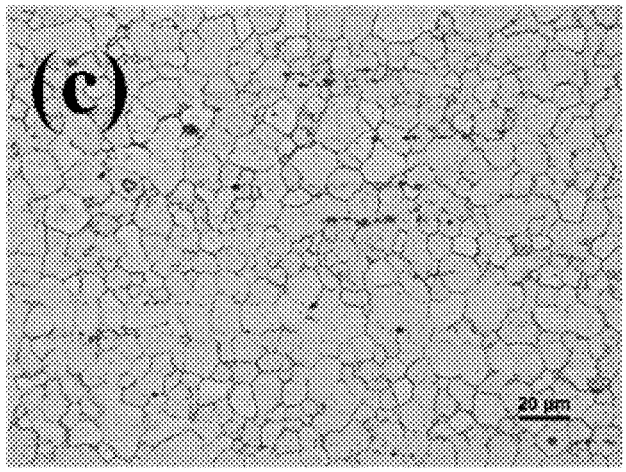
Figure 9A:
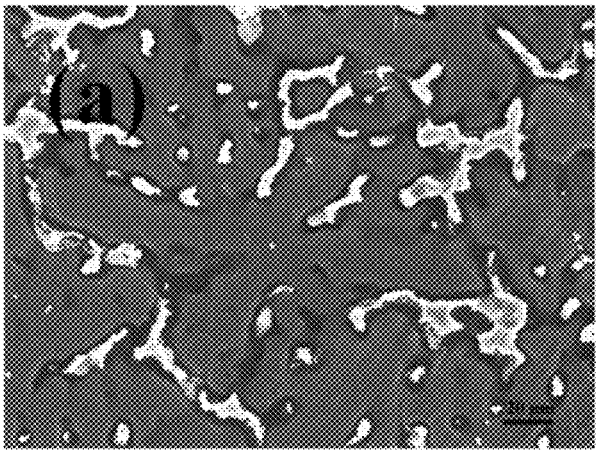
FIG. 9*a*-9*c* shows a microstructure of the Comparative Example of the present disclosure observed with a SEM.
Figure 9B:
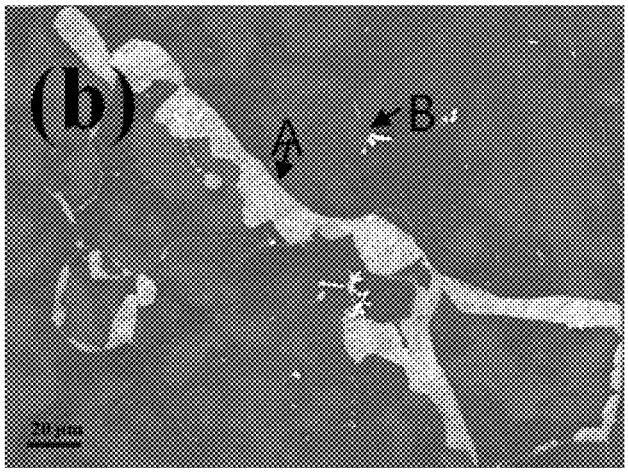
Figure 9C:
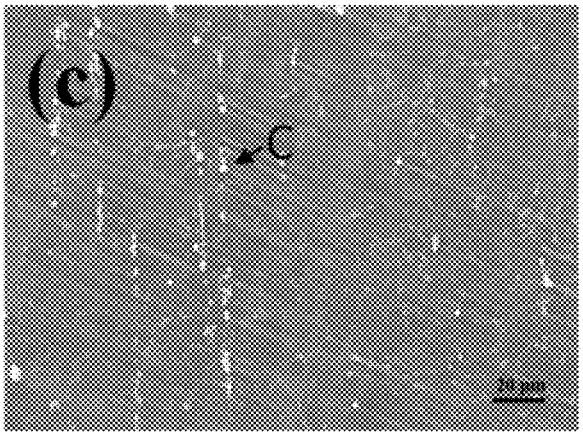

In order to more clearly understand characteristics of the magnesium alloys of the Examples of the present disclosure, microstructure of the Examples 1-3 and the Comparative Example are also acquired. FIG. 4*a*-4*c* shows a microstructure of Example 1 of the present disclosure observed with an OM (Optical Microscope). FIG. 5*a*-5*c* shows a microstructure of Example 1 of the present disclosure observed with a SEM (Scanning Electron Microscope). FIG. 6*a*-6*b* shows a microstructure of Example 2 of the present disclosure observed with an OM. FIG. 7*a*-7*b* shows a microstructure of Example 3 of the present disclosure observed with an OM. FIG. 8*a*-8*c* shows a microstructure of the Comparative Example of the present disclosure observed with an OM. FIG. 9*a*-9*c* shows a microstructure of the Comparative Example of the present disclosure observed with a SEM.

Through FIG. 4*a*, FIG. 5*a*, FIG. 8*a* and FIG. 9*a*, it is observed that crystal grains of the Examples of the present disclosure are obviously refined, second phases of the Examples of the present disclosure are changed into dispersed distribution compared with a continuous thick second phase of as-cast state tissue of the Comparative Example, and a splitting action on a matrix is weakened, which results in improvement on mechanical properties shown in FIG. 1. Through analyzing FIG. 4*b*, FIG. 5*b*, FIG. 8*b* and FIG. 9*b*, it is discovered that after T6 treatment, all magnesium alloys are subjected to aging precipitation, and tissue is improved compared with the as-cast state tissue. Through further comparing aged state tissue of the Example 1 with aged state tissue of the comparative example, it is discovered that the aged state tissue of the Example 1 is smaller, a crystal-boundary non-continuous precipitated phase is reduced in size and is more dispersed, and meanwhile, the quantity of intracrystalline precipitated phases is more, so that aging precipitation behaviors of the magnesium alloys of the Examples of the present disclosure are improved, new dispersed second phases are formed, and thus, mechanical properties of the alloys are further improved.

Through FIG. 4*c*, FIG. 5*c*, FIG. 8*c* and FIG. 9*c*, it is observed that after extrusion treatment, all magnesium alloys are subjected to dynamic recrystallization, the microstructures present small equiaxed grain tissue, crystal grain sizes are obviously refined compared with those of an as-cast state, a great deal of reticulated Mg17Al12 phases in cast-state alloy tissue are soluble to a matrix in a solid solution process, undissolved second phases are distributed in an extruded direction, and the growth of alpha-Mg crystal grains during dynamic recrystallization can be hindered due to the presence of these undissolved phases.

In order to determine ingredients of the second phases, EDS (Energy Dispersive Spectrometer) elemental analysis is further performed, a result shows that besides a Mg17Al12 phase, stripped-distributed second phases in the alloy of the Example 1 may also have a Mg—Al—Sn phase and a Mg—Al—Sm phase, referring to FIG. 10, these micron-scale second phases are relatively high in melting point and are difficult in solid solution in a matrix during solid solution treatment, and dynamic recrystallization can be promoted in a subsequent deformation process in a particle stimulated nucleation manner, so that comprehensive mechanical properties of deformed alloys are improved. Second phases in the comparative example only have a Mg17Al12 phase, referring to FIG. 11.

Those that are not explained or not clearly explained in the description are technologies known in the art.

The above contents are only specific descriptions of Examples of the present disclosure and not intended to limit the scope of protection of the present disclosure, and other any equivalent transformation shall fall within the scope of protection of the present disclosure.

The invention claimed is:

1. A preparation method of a magnesium alloy comprising Al: 7.01-9.98 wt %; Zn: 0.1-1.2 wt %; Mn: 0.05-0.2 wt %; Sn: 0.3-2.5 wt %; Sm: 0.1-0.5 wt %; and a balance of Mg, comprising:

heating a solid raw material of Mg to 700-730° C. for melting to form a Mg melt;

heating solid raw materials of rest ingredients to preset temperatures of the ingredients, then adding the Mg melt for melting, and stirring for a preset time to form a mixed melt; and solidifying the mixed melt to form the magnesium alloy.

2. The method according to claim 1, wherein the step of heating solid raw materials of rest ingredients to preset temperatures of the ingredients, then adding the Mg melt for melting, and stirring for a preset time to form the mixed melt comprises:

separately heating solid raw materials of Sn and Zn to 50-100° C., heating solid raw materials of Al, Mn, Sm, Y and Ca to 150-250° C., adding the Mg melt, raising a temperature of the Mg melt by 20-40° C., maintaining the raised temperature for 5-15 minutes, and then stirring for 3-10 minutes to form the mixed melt.

3. The method according to claim 2, wherein after the step of heating solid raw materials of rest ingredients to preset temperatures of the ingredients, then adding the Mg melt for melting, and stirring for a preset time to form the mixed melt and before the step of solidifying the mixed melt to form the magnesium alloy, the method further comprises:

lowering the temperature of the mixed melt by 20-40° C. for refining degassing treatment, and then maintaining the lowered temperature for 3-15 minutes for standing treatment.

4. The method according to claim 3, wherein forming the mixed melt through heating all the ingredients in sequence for melting all the ingredients is performed under the protection of $CO_2/SF_6$ mixed gas.

5. The method according to claim 4, wherein the step of solidifying the mixed melt to form the magnesium alloy comprises:

removing dross on a surface of the mixed melt, and then preparing a magnesium alloy ingot by gravity casting or semicontinuous casting.

6. The method according to claim 5, wherein after the step of removing dross on a surface of the mixed melt, and then preparing a magnesium alloy ingot by gravity casting or semicontinuous casting, the method further comprises:

performing solid solution treatment on the magnesium alloy ingot, wherein the solid solution treatment comprises:

performing solid solution treatment for 7-24 hours at a temperature of 380-430° C., and then quenching with warm water with a temperature of 40-80° C.

7. The method according to claim 6, wherein after the step of performing solid solution treatment on the magnesium alloy ingot, the method further comprises:

performing aging treatment on the magnesium alloy ingot, wherein the aging treatment comprises:

firstly maintaining a temperature of 300-350° C. for 0.5-2 h, then maintaining a temperature of 150-200° C. for 8-15 h, and finally cooling to room temperature.

* * * * *